US007509804B2

(12) United States Patent
Kobayashi

(10) Patent No.: US 7,509,804 B2
(45) Date of Patent: Mar. 31, 2009

(54) TURBOCHARGER WITH VARIABLE NOZZLE

(75) Inventor: Takahiro Kobayashi, Tokyo (JP)

(73) Assignee: IHI Corporation, Tokyo (JP)

( * ) Notice: Subject to any disclaimer, the term of this patent is extended or adjusted under 35 U.S.C. 154(b) by 207 days.

(21) Appl. No.: 11/668,603

(22) Filed: Jan. 30, 2007

(65) Prior Publication Data

US 2007/0175216 A1 Aug. 2, 2007

(30) Foreign Application Priority Data

Feb. 2, 2006 (JP) ..... 2006-026046

(51) Int. Cl.
*F02D 23/00* (2006.01)
*F01D 17/12* (2006.01)
*F01D 17/18* (2006.01)
*F01D 25/08* (2006.01)

(52) U.S. Cl. ..... 60/602; 415/158; 415/164

(58) Field of Classification Search ..... 60/602; 415/159–164, 177; 417/406–407
See application file for complete search history.

(56) References Cited

U.S. PATENT DOCUMENTS 2,860,827 A * 11/1958 Egli ..... 415/164
3,101,926 A * 8/1963 Weber ..... 415/164
4,659,295 A 4/1987 Burdette et al. ..... 415/164
4,804,316 A * 2/1989 Fleury ..... 415/164
4,820,118 A * 4/1989 Yano et al. ..... 415/164
5,207,565 A * 5/1993 Roessler ..... 417/407
5,441,383 A * 8/1995 Dale et al. ..... 415/158
6,145,313 A * 11/2000 Arnold ..... 60/605.2
6,739,134 B2 * 5/2004 Fledersbacher et al. ..... 415/158
6,925,806 B1 * 8/2005 Zollinger et al. ..... 60/602
7,001,142 B2 * 2/2006 Knauer et al. ..... 415/164
7,024,855 B2 * 4/2006 Perrin et al. ..... 415/158
7,097,432 B1 * 8/2006 Lombard et al. ..... 415/158
7,189,058 B2 * 3/2007 Metz et al. ..... 415/165
7,249,930 B2 * 7/2007 Lombard et al. ..... 60/602
7,322,791 B2 * 1/2008 Stilgenbauer ..... 415/164
7,338,254 B2 * 3/2008 Lombard et al. ..... 415/167
2006/0127244 A1 * 6/2006 Frankenstein et al. ..... 417/407
2007/0122268 A1 * 5/2007 Limbard et al. ..... 415/158
2008/0031728 A1 * 2/2008 Sausse et al. ..... 415/160
2008/0080966 A1 * 4/2008 Ueno et al. ..... 415/112

FOREIGN PATENT DOCUMENTS

JP 7-13468 2/1995

* cited by examiner

*Primary Examiner*—Thai-Ba Trieu
(74) *Attorney, Agent, or Firm*—Griffin & Szipi, P.C.

(57) ABSTRACT

A turbocharger with a variable nozzle has a turbine impeller, a compressor impeller, a shaft coupling the turbine impeller and the compressor impeller, a bearing housing rotatably supporting the shaft, and a turbine housing accommodating the turbine impeller. The turbocharger further includes a variable nozzle mechanism, provided in a compressor impeller side in a radial-direction outer side of the turbine impeller, for adjusting a flow rate of an exhaust gas directed to the turbine impeller. The bearing housing has a radially expanded portion that extends to a radial-direction outer side to be coupled to the turbine housing at a radial-direction outer side portion thereof such that the variable nozzle mechanism is accommodated between the turbine housing and the radially expanded portion. Between the variable nozzle mechanism and the radially expanded portion, a heat shield plate is provided for preventing a heat transmission between them.

3 Claims, 3 Drawing Sheets

TURBOCHARGER WITH VARIABLE NOZZLE

BACKGROUND OF THE INVENTION

1. Technical Field of the Invention

The present invention relates to a turbocharger with a variable nozzle, and more particularly to a turbo charger with a variable nozzle having a mechanism capable of suppressing a temperature increase of a compressor side thrust bearing or the like.

2. Description of the Related Art

A turbocharger is a supercharger used for a high output of an engine, for example, for a motor vehicle. In the turbocharger, a compressed air is supplied to the engine from a compressor by rotating a turbine impeller by exhaust energy of the engine, and rotating a compressor impeller by an output of the turbine. Accordingly, it is possible to achieve a supercharging state over a natural air supply in the engine.

In the turbocharger, at the time of low speed revolution of the engine, the turbine hardly works due to a low exhaust flow rate. Accordingly, in the engine capable of operating at a high speed revolution, it takes a long time until the turbine efficiently rotates, so that it is impossible to quickly obtain a turbo effect.

Accordingly, there has been developed a turbocharger with a variable nozzle (a variable geometry system turbocharger (VGS)) which is efficiently activated even from a low speed revolution range of the engine. The turbocharger with the variable nozzle is structured such that a high output can be obtained even at a time of a low speed revolution, by throttling a small exhaust flow by a movable vane, increasing a speed of the exhaust gas and enlarging a work load of the turbine. The turbocharger with the variable nozzle as mentioned above is described, for example, in Japanese Examined Patent Publication No. 7-13468 "turbocharger".

However, in the turbocharger with the variable nozzle, there is a problem that a temperature of a thrust bearing provided in a compressor side of a bearing housing gets over a critical temperature 250° C. so as to be increased to about 300° C. due to a heat transmission (a heat soak) from a turbine side of the bearing housing to the compressor side, at a time when the engine stops and a pressure oil cooling the bearing housing stops. Meanwhile, the problem mentioned above is not particularly pointed out in the turbocharger with no variable nozzle.

SUMMARY OF THE INVENTION

Accordingly, an object of the present invention is to provide a turbocharger with a variable nozzle having a mechanism capable of maintaining a temperature of a thrust bearing or the like equal to or less than a critical temperature.

According to the present invention, in order to achieve the object mentioned above, there is provided a turbocharger with a variable nozzle comprising:

a turbine impeller rotationally driven by an exhaust gas;

a compressor impeller rotationally driven by the turbine impeller so as to compress an air;

a shaft coupling the turbine impeller and the compressor impeller;

a bearing housing rotatably supporting the shaft;

a turbine housing accommodating the turbine impeller in an inner portion thereof; and a variable nozzle mechanism, provided in a compressor impeller side in a radial-direction outer side of the turbine impeller, for adjusting a flow rate of an exhaust gas directed to the turbine impeller, wherein the bearing housing has a radially expanded portion that extends to a radial-direction outer side to be coupled to the turbine housing at a radial-direction outer side portion thereof such that the variable nozzle mechanism is accommodated between the turbine housing and the radially expanded portion, and a heat shield plate is provided between the variable nozzle mechanism and the radially expanded portion for preventing a heat transmission between the variable nozzle mechanism and the radially expanded portion.

As for a turbocharger with the variable nozzle, since the variable nozzle mechanism is accommodated between the turbine housing and the bearing housing, the bearing housing has the radially expanded portion extending in the radial direction to be coupled to the radial-direction outer side portion of the turbine housing. Accordingly, the bearing housing is enlarged in size in comparison with the conventional one, and a heat capacity thereof becomes enlarged at that degree. In a hydraulic cooling, it is impossible to sufficiently cool the heat of the radially expanded portion in the bearing housing. However, in the turbocharger with the variable nozzle in accordance with the present invention mentioned above, since the heat shield plate is provided between the variable nozzle mechanism and the radially expanded portion of the bearing housing, in the outer side in the radial direction, it is possible to prevent the heat from being transmitted to the radially expanded portion from the turbine side. In other words, the heat shield plate is provide by providing a space between the variable nozzle mechanism and the radially expanded portion so that radiant heat from high-temperature components at the turbine side can be prevented from transmitting directly to the bearing housing, suppressing a temperature increase in the bearing housing. Accordingly, it is possible to suppress the heating of the radially expanded portion in the bearing housing. As a result, even when the engine stops and supply of the pressure oil for cooling the bearing housing stops, it is possible to maintain the temperature of the thrust bearing or the like equal to or less than the critical temperature.

According to a preferable aspect of the present invention, the heat shield plate has a radial-direction outer end portion sandwiched and held between the turbine housing and the bearing housing.

Accordingly, since the heat shield plate can be fixed by only holding the heat shield plate between the turbine housing and the bearing housing, at a time of assembling the turbocharger, it is easy to fix the heat shield plate.

Further, since the radial-direction outer end portion of the heat shield plate is sandwiched and held between the turbine housing and the bearing housing, the heat shield plate can be attached such that the radial-direction outer end portion of the heat shield plate contacts with the turbine housing and the bearing housing, and such that the other portion of the heat shield plate does not contact with the turbine housing and the bearing housing.

Accordingly, even if the heat transmission from the turbine side to the radially expanded portion of the bearing housing is generated through the contact portion existing in the radial-direction outer end portion of the heat shield plate, the other portion of the heat shield plate does not contact with the turbine housing and the bearing housing, so that it is possible to minimize an amount of heat transmission from the turbine side to the radially expanded portion through this non-contact portion. Therefore, it is possible to further effectively prevent the heat transmission from the turbine side to the radially expanded portion.

Further, according to a preferable aspect of the present invention, the heat shield plate is constituted by an annular member having an opening portion in a center thereof, and the bearing housing has a radially contracted portion that protrudes to the turbine housing side from the radially expanded portion to be fitted into the opening portion.

Accordingly, since it is possible to attach the heat shield plate to the bearing housing by only fitting the radially contracted portion of the bearing housing into the opening portion of the heat shield plate, even at a time of assembling the turbocharger, it is easy to attach the heat shield plate.

In the present invention mentioned above, since the heat shield plate is provided between the variable nozzle mechanism and the radially expanded portion of the bearing housing, it is possible to prevent the heat transmission from the turbine side to the radially expanded portion. Accordingly, it is possible to suppress the heating of the radially expanded portion in the bearing housing. As a result, even when the engine stops and supply of the pressure oil for cooling the bearing housing stops, it is possible to maintain the temperature of the thrust bearing or the like equal to or less than the critical temperature.

The other objects and advantageous features of the present invention will be apparent from the following description with reference to the accompanying drawings.

DESCRIPTION OF THE PREFERRED EMBODIMENT

Figure 1:
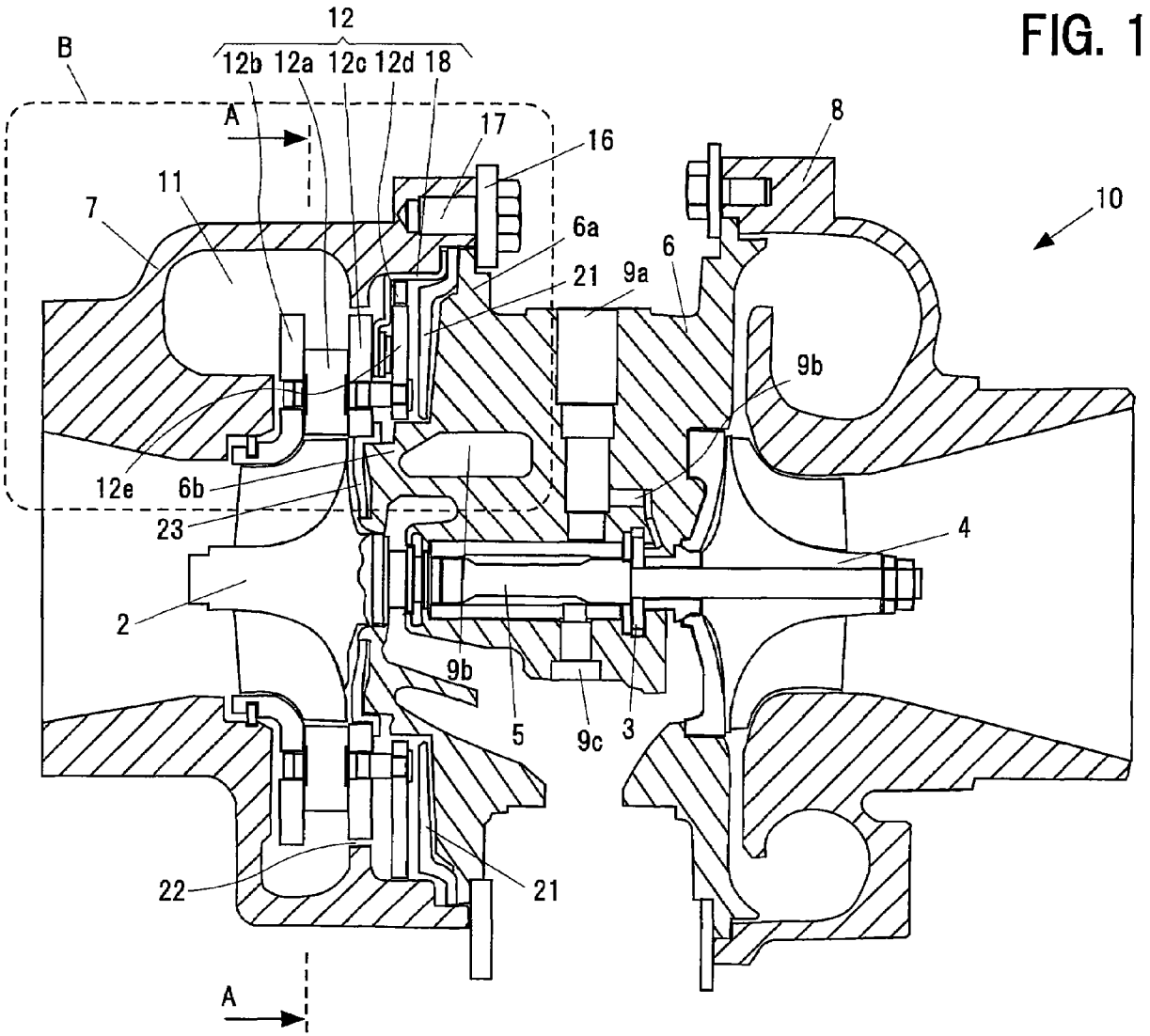
FIG. 1 is a view of an entire structure of a turbocharger with a variable nozzle in accordance with an embodiment of the present invention.

The description will be given of a preferable embodiment in accordance with the present invention with reference to the accompanying drawings. Meanwhile, the same reference numerals are attached to common portions in each of the drawings, and the repeated description will be omitted.

Figure 2:
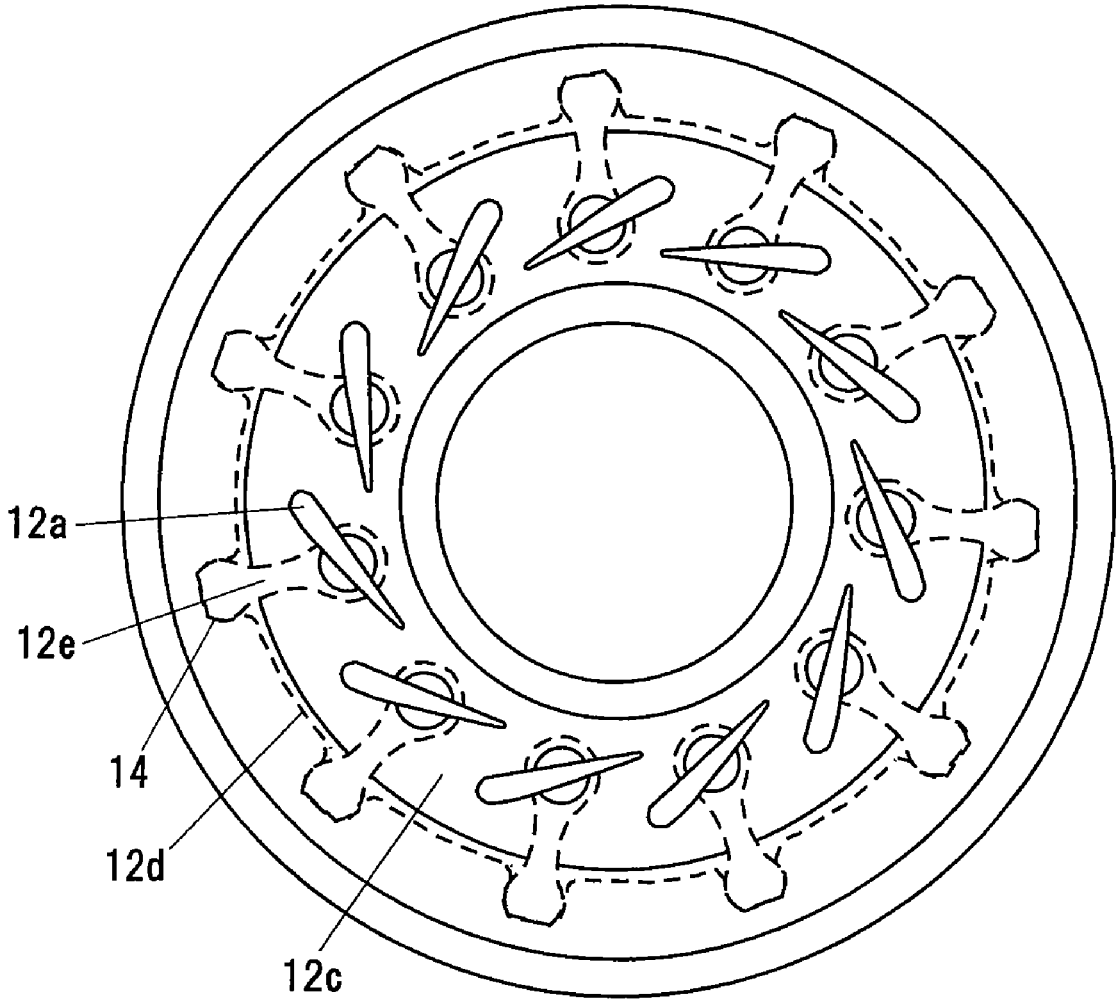
FIG. 2 is a cross sectional view along a line A-A in FIG. 1, and a view showing a variable nozzle mechanism.

FIG. 1 is a cross sectional view in an axial direction of a turbocharger 10 with a variable nozzle showing an embodiment in accordance with the present invention. FIG. 2 is a view along a line A-A in FIG. 1, and shows a variable nozzle mechanism 12 adjusting a flow rate of an exhaust gas from an engine to a turbine.

A turbocharger 10 with a variable nozzle shown in FIG. 1 is provided with a turbine impeller 2 rotationally driven by the exhaust gas from the engine, a compressor impeller 4 rotationally driven by a driving force of the turbine so as to supply a compressed air to the engine, a shaft 5 coupling the turbine impeller 2 and the compressor impeller 4, a bearing housing 6 rotatably supporting the shaft 5, a turbine housing 7 accommodating the turbine impeller 2 in an inner side in a radial direction, and a compressor housing 8 accommodating the compressor impeller 4 in an inner side in a radial direction. The bearing housing 6 is provided with an oil supply port 9*a*, an oil path 9*b* and an oil discharge port 9*c* for cooling the bearing housing 6, the thrust bearing 3 and the like.

A scroll 11 in which the exhaust gas from the engine is fed is formed in an inner portion of the turbine housing 7. Further, the turbocharger 10 with the variable nozzle is further provided with a variable nozzle mechanism 12 controlling a flow rate of the exhaust gas fed in the scroll 11 so as to adjust a flow rate of the exhaust gas to the turbine impeller 2 positioned in the inner side in the radial direction.

As shown in FIGS. 1 and 2, the variable nozzle mechanism 12 has a plurality of movable vanes 12*a* arranged so as to be spaced in a circumferential direction, a first ring member 12*b* and a second ring member 12*c* holding the movable vanes 12*a* in such a manner as to pinch them in an axial direction, a plurality of transmission members 12*e* fixed to roots of shaft portions of a plurality of movable vanes 12*a* so as to extend to an outer side in the radial direction, and a third ring member 12*d* having a plurality of grooves 14 formed in a circumferential direction to engage with the radial-direction outer end portions of the transmission members 12*e*. As is known from FIG. 1, the variable nozzle mechanism 12 is provided in the compressor impeller 4 side in the radial direction outer side of the turbine impeller 2.

Since the third ring member 12*d* is rotated in the circumferential direction by a cylinder (not shown) or the like, the grooves 14 of the third ring member 12*d* are moved in the circumferential direction, and this movement causes a plurality of transmission members 12*e* engaging with the grooves 14 to be swung in the circumferential direction. Thereby, the movable vanes 12*a* are also swung. By controlling a swing amount of the movable vanes 12*a*, it is possible to control a flow rate of the exhaust gas to the turbine impeller 2.

Figure 3:
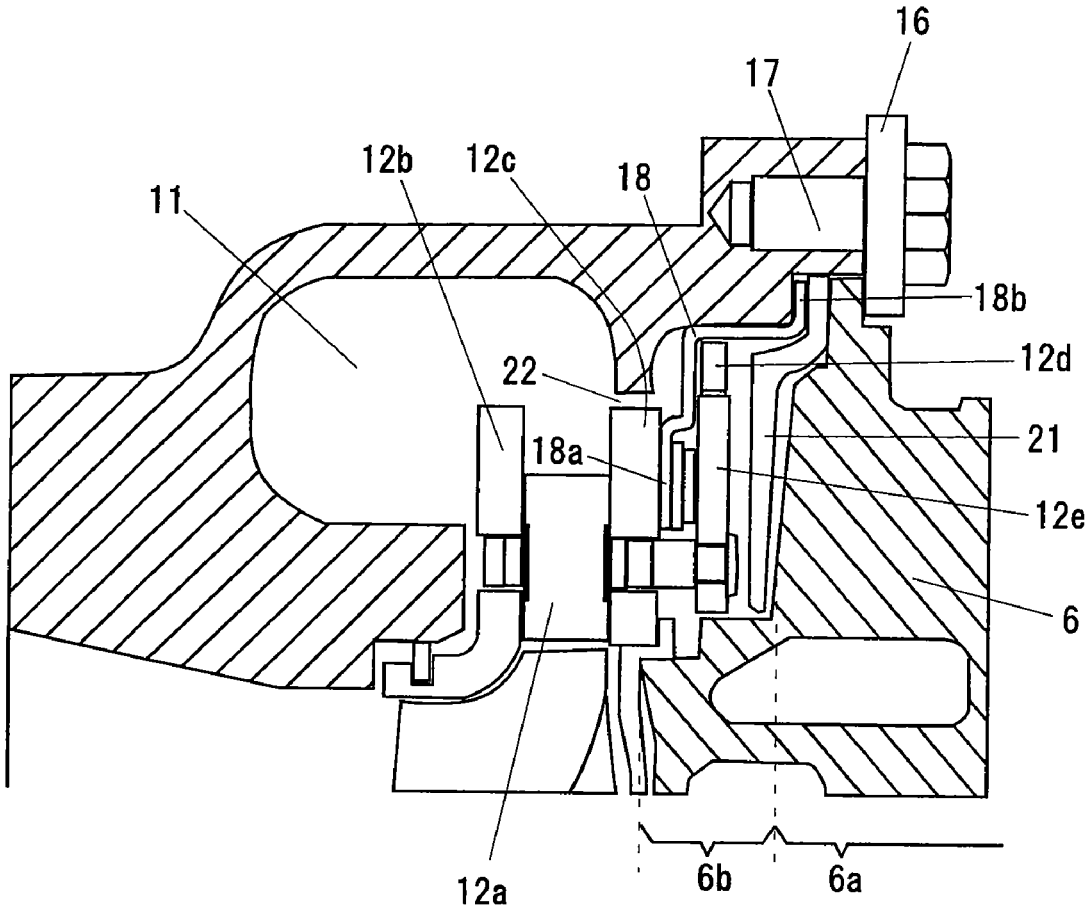
FIG. 3 is an enlarged view of a portion surrounded by a broken line B in FIG. 1.

FIG. 3 is an enlarged view of a portion surrounded by a broken line B in FIG. 1. As shown in FIGS. 1 and 3, the movable nozzle mechanism 12 is provided in a radial-direction outer side of the turbine impeller 2. In order to attach the variable nozzle mechanism 12, the bearing housing 6 has a radially expanded portion 6*a* extending to an outer side in the radial direction so as to be connected to an outer end portion of the turbine housing 7 in an axial direction. The radial-direction outer end portion of the radially expanded portion 6*a* and the radial-direction outer end portion of the turbine housing 7 are connected in the axial direction by a bolt 17 by using a connection plate 16. Further, the variable nozzle mechanism 12 has a mounting member 18. One end portion 18*a* of the mounting member 18 is fixed to the second ring member 12*c*, and the other end portion 18*b* of the mounting member 18 is sandwiched and held between the radial-direction outer end portion of the radially expanded portion 6*a* and the radial-direction outer end portion of the turbine housing 7. That is, the variable nozzle mechanism 12 is held between the turbine housing 7 and the bearing housing 6 by the mounting member 18. In this manner, the variable nozzle mechanism 12 is accommodated between the turbine housing 7 and the radially expanded portion 6*a* of the bearing housing 6. Meanwhile, the bearing housing 6 has a radially contracted portion 6*b* having a smaller diameter in the turbine side end portion. An opening portion in a center in the radial direction of the third ring member 12*d* of the variable nozzle mechanism 12 is passed through the radially contracted portion 6*b*, whereby the third ring member 12*d* is attached to the radially contracted portion.

As mentioned above, since the radially expanded portion 6*a* is provided in the bearing housing 6 for attaching the variable nozzle mechanism 12 to the turbocharger, a radial-direction dimension of the bearing housing 6 is enlarged. Paying attention to this point, there is considered that the temperature of the thrust bearing of the turbocharger 10 with the variable nozzle is conventionally increased to about 300°

C. over the critical temperature 250° C. because the bearing housing 6 is enlarged in size and the heat capacity thereof becomes large. That is, in accordance with the conventional cooling structure by the pressure oil, even if the bearing housing 6 is cooled during the engine operation, it is impossible to sufficiently cool the radially expanded portion 6*a*. Therefore, the radially expanded portion 6*a* comes to a higher temperature in comparison with the other portion (for example, the compressor side of the bearing housing 6). Further, there can be considered if the pressure oil supply stops after stopping the engine, the heat is transmitted to the compressor side of the bearing housing 6 (heat soak), whereby the temperature in the compressor side of the bearing housing 6 is increased, so that the temperature of the thrust bearing 3 is increased to about 300° C. over the critical temperature 250° C.

In accordance with the present invention, a heat shield plate is provided in accordance with a method peculiar to the present invention, as described below, on the basis of the fact that the temperature increase of the thrust bearing is caused by the enlargement in size of the bearing housing 6.

In accordance with an embodiment of the present invention, a heat shield plate 21 having an opening portion in a center in the radial direction is attached to have a cross section vertical to the axial direction that is formed in an annular shape. As shown in FIG. 3, the heat shield plate 21 is attached to the bearing housing 6 by passing the radially contracted portion of the bearing housing 6 through the opening portion of the heat shield plate 21. Further, as shown in FIG. 3, a radial-direction outer end portion of the heat shield plate 21 is sandwiched and held between the radial-direction outer end portion of the turbine housing 7 and the radial-direction outer end portion of the radially expanded portion 6*a*, together with the other end portion 18*b* of the mounting member 18 mentioned above. Accordingly, it is possible to fix the heat shield plate 21 between the turbine housing 7 and the bearing housing 6.

Further, in accordance with this fixing method, it is possible to make the arrangement that only the radial-direction outer end portion of the heat shield plate 21 contacts with the turbine housing 7 and the bearing housing 6, and the other portion of the heat shield plate 21 does not contact with the other members including the turbine housing 7 and the bearing housing 6.

Meanwhile, as shown in FIG. 3, there is provided a communication hole 22 for setting the scroll 11 and the second ring member 12*c* to a communication state. If the communication hole 22 is not provided, a pressure difference is generated between the scroll 11 side and a space that is positioned between the second ring member 12*c* and the third ring member 12*d*, on the boundary of the second ring member 12*c*. Thereby, together with unburned carbon, exhaust gas from the scroll side flows into the space between the second ring member 12*c* and the third ring member 12*d* through a clearance at the shaft of the movable vanes 12*a* for a relatively long time. As a result the space between the second ring member 12*c* and the third ring member 12*d* is clogged with a carbon. Accumulation of the carbon at a moving part of the movable vanes 12*a* prevents the movable vanes 12*a* from smoothly moving. For this reason, the communication hole 22 is provided so as to do away with the pressure difference. Thereby, it becomes difficult for the flow from the scroll side to enter the space between the second ring member 12*c* and the third ring member 12*d* through the clearance at the shaft of the movable vanes 12*a* for a relatively long time. As a result, the carbon clogging is prevented. Furthermore, the communication hole 22 not only removes the pressure difference, but also promotes a uniform temperature in the variable nozzle mechanism 12 for a relatively short time to prevent carbon adhesion thereto. Taking this matter into consideration, in accordance with the embodiment of the present invention, the heat shield plate 21 is provided in the bearing housing 6 side with respect to the third ring member 12*d*. Meanwhile, reference numeral 23 denotes a conventionally attached heat shield plate.

Further, a material of the heat shield plate 21 is stainless steel (JIS G 4305, for example) such as SUS304 or SUS310. However, the material of the heat shield plate 21 may be the other proper materials which can obtain a heat shielding effect. Meanwhile, the material of the heat shield plate 21 may be constituted by the same material as the material of the heat shield plate 23 provided in the other position.

It is possible to prevent the heat transmission between the turbine side and the radially expanded portion 6*a* of the bearing housing 6, by the heat shield plate 21 mentioned above, and it is possible to suppress the temperature increase of the enlarged bearing housing 6 (particularly, the radially expanded portion 6*a*). Further, since it is possible to prevent a cold from being transmitted from the bearing housing 6 to the turbine side by the heat shield plate 21, as compare to a conventional case, it is possible to more prevent the carbon from being accumulated near the nozzle variable mechanism.

Further, since the radial-direction outer end portion of the heat shield plate 21 is fixed so as to be sandwiched and held between the turbine housing 7 and the bearing housing 6 together with the mounting member 18 of the variable nozzle mechanism 12, it is possible to easily attach and fix the heat shield plate 21 to the bearing housing 8.

Further, by this fixing method, it is possible to make the arrangement that the radial-direction outer end portion of the heat shield plate 21 contacts with the turbine housing 7 and the bearing housing 6, and the other portion of the heat shield plate 21 does not contact with the turbine housing 7 and the bearing housing 6. Thereby, it is possible to minimize the amount of heat transmission from the turbine side to the radially expanded portion through the non-contact portion of the heat shield plate 21. Accordingly, it is possible to further effectively prevent the heat transmission from the turbine side to the radially expanded portion 6*a*.

Meanwhile, it goes without saying that the present invention is not limited to the embodiments mentioned above, but can be variously modified within the scope of the present invention. For example, although in the embodiment mentioned above, the heat shield plate 21 is applied to the turbocharger 10 with the variable nozzle in which the radial-direction outer end portion of the turbine housing 7 is connected to the radial-direction outer end portion of the radially expanded portion 6*a* of the bearing housing 6 by the bolt 17, the heat shield plate 21 can be applied to the turbocharger 10 in which the turbine housing 7 and the bearing housing 6 are connected at a proper position in the radial-direction outer portion, and the variable nozzle mechanism 12 is accommodated between them.

The invention claimed is:

1. A turbocharger with a variable nozzle comprising:

a turbine impeller rotationally driven by an exhaust gas;

a compressor impeller rotationally driven by the turbine impeller so as to compress an air;

a shaft coupling the turbine impeller and the compressor impeller;

a bearing housing rotatably supporting the shaft;

a turbine housing accommodating the turbine impeller in an inner portion thereof; and a variable nozzle mechanism, provided in a compressor impeller side in a radial-direction outer side of the turbine impeller, for adjusting a flow rate of an exhaust gas directed to the turbine impeller, wherein the bearing housing has a radially expanded portion that extends to a radial-direction outer side to be coupled to the turbine housing at a radial-direction outer side portion thereof such that the variable nozzle mechanism is accommodated between the turbine housing and the radially expanded portion, and a heat shield plate is provided between the variable nozzle mechanism and the radially expanded portion for preventing a heat transmission between the variable nozzle mechanism and the radially expanded portion.

2. The turbocharger as claimed in claim 1, wherein the heat shield plate has a radial-direction outer end portion sandwiched and held between the turbine housing and the bearing housing.

3. The turbocharger as claimed in claim 1, wherein the heat shield plate is constituted by an annular member having an opening portion in a center thereof, and the bearing housing has a radially contracted portion that protrudes to a turbine housing side from the radially expanded portion to be fitted into the opening portion.

* * * * *